US011737201B2

(12) United States Patent
Cashen et al.

(10) Patent No.: US 11,737,201 B2
(45) Date of Patent: Aug. 22, 2023

(54) COLLIMATED ATOMIC BEAM SOURCE HAVING A SOURCE TUBE WITH AN OPENABLE SEAL

(71) Applicant: Vector Atomic, Inc., Pleasanton, CA (US)

(72) Inventors: Matthew T. Cashen, Pleasanton, CA (US); Arman Cingoz, Pleasanton, CA (US); Artyom Vitouchkine, South San Francisco, CA (US)

(73) Assignee: Vector Atomic, Inc., Pleasanton, CA (US)

( * ) Notice: Subject to any disclaimer, the term of this patent is extended or adjusted under 35 U.S.C. 154(b) by 292 days.

(21) Appl. No.: 16/862,524

(22) Filed: Apr. 29, 2020

(65) Prior Publication Data

US 2021/0345475 A1 Nov. 4, 2021

(51) Int. Cl.
*H05H 3/02* (2006.01)

(52) U.S. Cl.
CPC ..... *H05H 3/02* (2013.01)

(58) Field of Classification Search
CPC ..... G21K 1/006; H05H 3/00; H05H 3/02
See application file for complete search history.

(56) References Cited

U.S. PATENT DOCUMENTS

| | | | | |
|---|---|---|---|---|
| 3,450,876 | A | 6/1969 | Kern et al. | |
| 3,967,115 | A | 6/1976 | Kern | |
| 7,126,112 | B2 * | 10/2006 | Anderson | G21K 1/006 250/251 |
| 2015/0200029 | A1 * | 7/2015 | Hughes | G21K 1/006 250/251 |

FOREIGN PATENT DOCUMENTS

JP 5302932 B2 * 10/2013

OTHER PUBLICATIONS

Hau et al., A new atomic beam source: The "candlestick"; Review of Scientific Instruments 65, 3746 (1994); https://doi.org/10.1063/1.1145246; Apr. 24, 1994.

Johnson et al., Molecular Beams Formed by Arrays of 3-40 μ Diameter Tubes; Journal of Applied Physics 37, 1551 (1966); https://doi.org/10.1063/1.1708566; Sep. 2, 1965.

Giordmaine et al., Molecular Beam Formation by Long Parallel Tubes; Journal of Applied Physics 31, 463 (1960); https://doi.org/10.1063/1.1735609; Aug. 13, 1959.

* cited by examiner

*Primary Examiner* — David A Vanore

(74) *Attorney, Agent, or Firm* — Clements Bernard Walker; Christopher L. Bernard

(57) ABSTRACT

Various disclosed embodiments include collimated beam atomic ovens, collimated atomic beam sources, methods of loading a source of atoms into an atomic oven, and methods of forming a collimated atomic beam. In some embodiments, an illustrative collimated beam atomic oven includes: a tube having a first portion and a second portion; a source of atoms disposed in the first portion of the tube; an aperture disposed in the second portion of the tube; a heater assembly disposable in thermal communication with the tube; and an openable seal disposed in the tube intermediate the source of atoms and the aperture.

19 Claims, 11 Drawing Sheets

COLLIMATED ATOMIC BEAM SOURCE HAVING A SOURCE TUBE WITH AN OPENABLE SEAL

TECHNICAL FIELD

The present disclosure relates to atomic beam sources.

BACKGROUND

A low-power, collimated alkali metal atomic beam source is desirable for atomic measurement instruments including, but not limited to, atomic clocks and atomic inertial sensors.

As is known, alkali metals typically selected to provide atoms, such as rubidium and cesium, react violently when exposed to air, thereby complicating the process of loading an atomic beam source. To that end, elemental rubidium and cesium are typically purchased in evacuated, sealed glass ampoules. Once loaded into atomic beam sources, these sealed glass ampoules are mechanically opened under vacuum to provide a reservoir of atoms for beam formation.

Referring to FIG. 1, a conventional atomic beam source 10 typically includes a conventional atomic oven 12. The atomic oven 12 includes a tube 14 that is loaded with a glass ampoule 16 that indues an alkali metal such as rubidium or cesium (an "alkali reservoir"). Because alkali metals typically selected to provide atoms react violently when exposed to air, the alkali metal in the ampoule 16 is not to be exposed to air during any part of the source fabrication process. The tube 14 is bolted and/or otherwise suitably sealed to a vacuum chamber 18. The atomic oven 14 is evacuated through the vacuum chamber 18 and is simultaneously heated to drive out trapped impurities. When a sufficiently low pressure is achieved in the vacuum chamber 18, the ampoule 16 is mechanically crushed to expose the alkali reservoir to the vacuum chamber 18. The atomic oven 12 is heated by a heater 20 (such as a resistive heater) to operate at an elevated temperature chosen to produce the desired beam flux (such as approximately 100° C. in some conventional devices). Alkali atoms escape through a capillary array 22, thereby forming a collimated atomic beam.

Typically and as shown in FIG. 1, the process of opening the ampoule 14 entails that the section of the atomic source that contains the ampoule 14 be physically accessible from an air side 24 of the atomic beam source 10 (so the ampoule 16 can be crushed—such as with pliers 25 or the like). Thus, the tube 14 extends into air (on the air side 24).

Atomic beams are generated by heating the atomic oven 12 to increase the vapor pressure of the alkali metal inside the tube 14. Physical surfaces of the tube 14 in air (such as on the air side 24) or attached to the atomic beam source 10 (such as via the seal) can introduce heat loss via convection or conduction. Thus, more power may be entailed to heat the atomic oven 12 to desired temperatures. Moreover, some of the heat may be transferred to walls 26 of the vacuum chamber 18. As a result, such heat losses can result in atomic beam source designs that can consume several-to-hundreds of watts of electrical power in seeking to achieve a desired atomic beam flux. In some cases, the heat may be removed by water cooling to keep the atomic beam source 10 at a reasonable operating temperature.

SUMMARY

Various disclosed embodiments include collimated beam atomic ovens, collimated atomic beam sources, methods of loading a source of atoms into an atomic oven, and methods of forming a collimated atomic beam.

In various embodiments, an illustrative collimated beam atomic oven includes: a tube having a first portion and a second portion; a source of atoms disposed in the first portion of the tube; an aperture disposed in the second portion of the tube; a heater assembly disposable in thermal communication with the tube; and an openable seal disposed in the tube intermediate the source of atoms and the aperture.

In other embodiments, an illustrative collimated atomic beam source includes: a vacuum chamber; and a collimated beam atomic oven disposed in the vacuum chamber. The collimated beam atomic oven includes: a tube having a first portion and a second portion, the tube being disposed entirely in the vacuum chamber; a source of atoms disposed in the first portion of the tube; an aperture disposed in the second portion of the tube; a heater assembly disposable in thermal communication with the tube; and an openable seal disposed in the tube intermediate the source of atoms and the aperture.

In other embodiments, another illustrative collimated atomic beam source includes: a vacuum chamber; and a collimated beam atomic oven disposed in the vacuum chamber. The collimated beam atomic oven includes: a tube having a first portion and a second portion, the tube being disposed entirely in the vacuum chamber; a metal disposed in an openable ampoule that is disposed in the first portion of the tube; an aperture disposed in the second portion of the tube; a heater assembly disposable in thermal communication with the tube; and an openable seal disposed in the tube intermediate the metal and the aperture. A mounting flange is configured to seal the atomic oven to the vacuum chamber. A thermally insulating standoff is disposed between the mounting flange and the tube, the thermally insulating standoff being configured to thermally insulate the tube from the mounting flange and the vacuum chamber.

In other embodiments, a method of loading a source of atoms into an atomic oven includes: disposing an openable seal in a tube intermediate a first portion of the tube and a second portion of the tube; loading a source of atoms into the first portion of the tube; creating a low pressure in the first portion of the tube; and sealing the first portion of the tube at a first end of the tube.

In other embodiments, a method of forming a collimated atomic beam includes: drawing a vacuum in a vacuum chamber; activating a source of atoms disposed in a sealed first portion of a tube that is disposed entirely in the vacuum chamber; compromising an openable seal disposed in the tube intermediate the source of atoms and a second portion of the tube; maintaining the tube at an operating temperature sufficient to establish a vapor pressure sufficient to emit atoms; and collimating the emitted atoms into a collimated beam of atoms.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

Illustrative embodiments are illustrated in referenced figures of the drawings. It is intended that the embodiments and figures disclosed herein are to be considered illustrative rather than restrictive.

DETAILED DESCRIPTION

Figure 1:
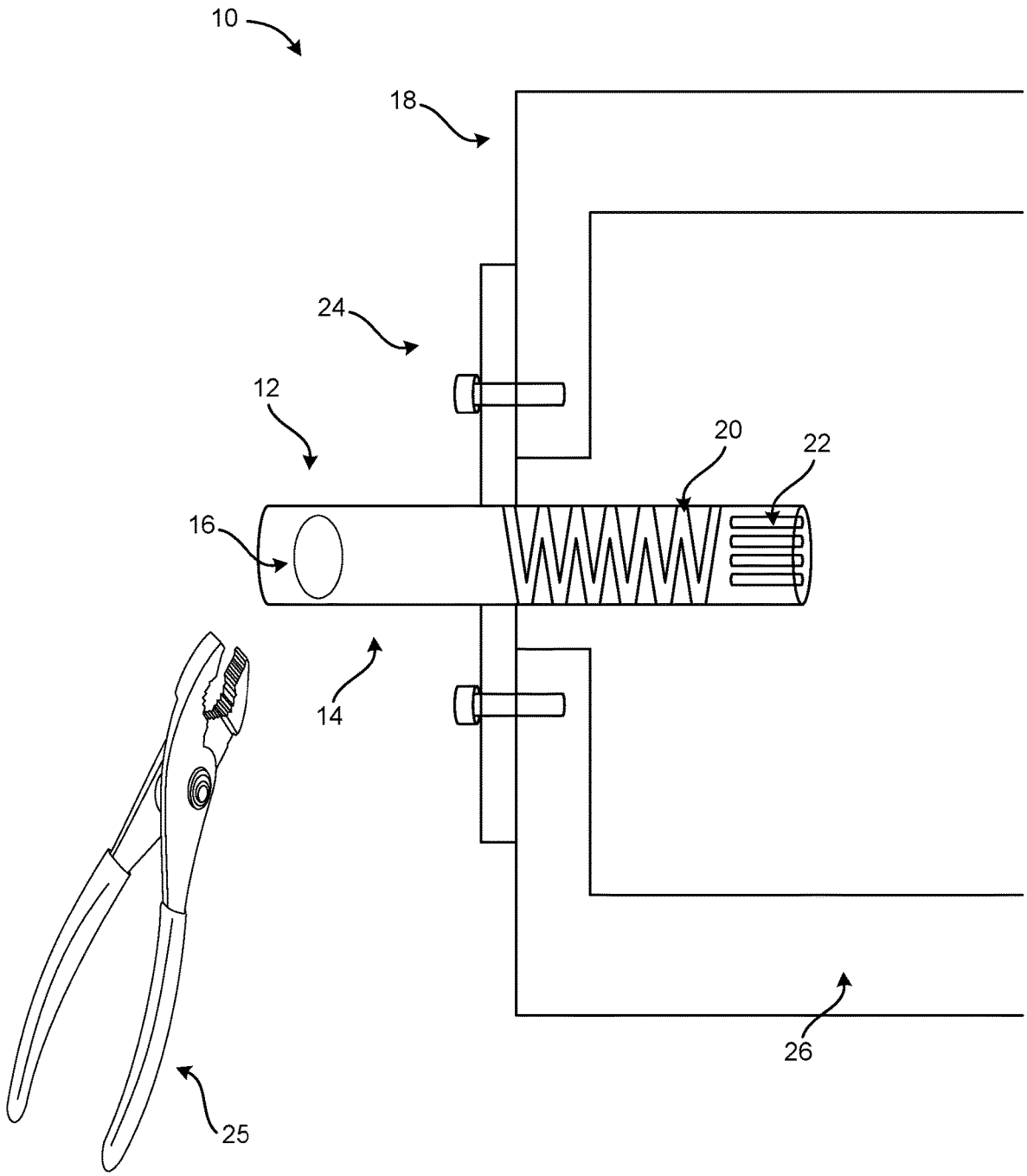
PRIOR ART FIG. 1
FIG. 1 is a side plan view in cutaway and in partial schematic form of a conventional atomic beam source.

In the following detailed description, reference is made to the accompanying drawings, which form a part hereof In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

By way of overview, various disclosed embodiments include collimated beam atomic ovens, collimated atomic beam sources, methods of loading a source of atoms into an atomic oven, and methods of forming a collimated atomic beam.

Figure 2:
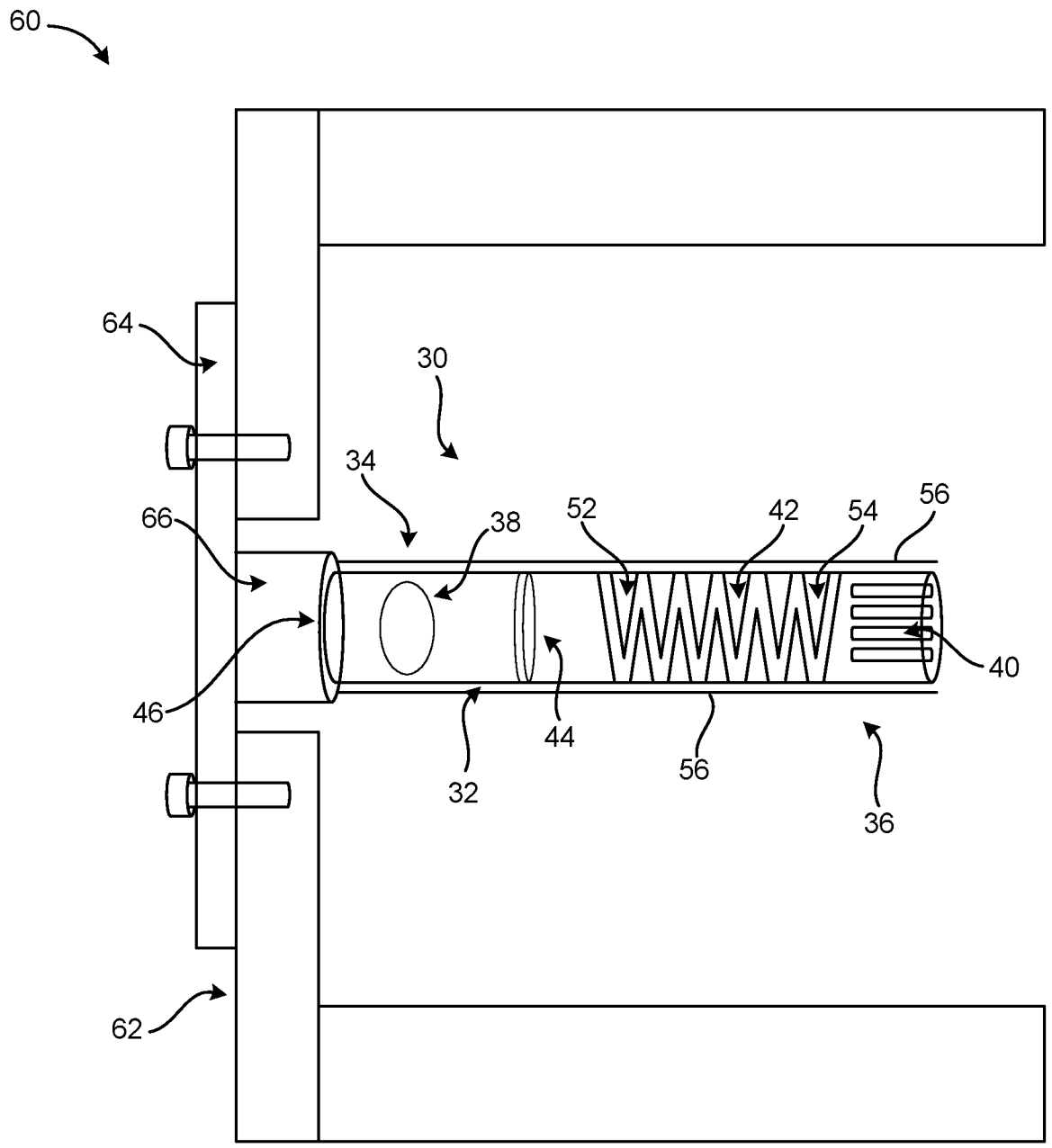
FIG. 2 is a side plan view in cutaway and in partial schematic form of an illustrative atomic beam source with an illustrative atomic oven.

Still by way of overview and referring to FIG. 2, in various embodiments an illustrative collimated beam atomic oven 30 includes a tube 32 having a portion 34 and a portion 36. A source of atoms 38 is disposed in the portion 34. An aperture 40 is disposed in the portion 36. A heater assembly 42 is disposed in thermal communication with the tube 32. An openable seal 44 is disposed in the tube 32 intermediate the source of atoms 38 and the aperture 40.

Still by way of overview, it will be appreciated that various embodiments may help contribute to reducing heat loss from the atomic oven 30 and may help contribute to reducing heater power entailed in forming a collimated atomic beam.

Now that an overview has been presented, details regarding various embodiments will be provided below via examples set forth by way of illustration only and not of limitation. After illustrative details regarding construction of illustrative embodiments are set forth, operation of various embodiments will be explained.

Still referring to FIG. 2, in some embodiments and as will be explained further below, the source of atoms 38 is loaded into the first portion 34 of the tube 32 and a low pressure is created in the first portion 34. In some such embodiments, the tube 32 is pinched off at an end 46 (such as via a cold-welded copper pinch), thereby sealing the first portion 34 via the pinched end 46 and the openable seal 44. It will be appreciated that use of a cold-welded copper pinch can help provide a way to evacuate the inside of the atomic source assembly on a vacuum manifold and then detach the source once evacuated. In such embodiments, it is desirable that the tube 32 be made of a material that can be pinched to create a seal. In some such embodiments and as also will be explained further below, the tube 32 is mechanically crushed at the first portion 34 to expose metal that was loaded into the tube 32 via the source of atoms 38, thereby permitting atoms to be emitted as desired. In such embodiments, the tube 32 may be desirably made of a material that is crimpable and mechanically crushable, such as without limitation copper, stainless steel, titanium, any combination thereof, and the like.

Figure 3:
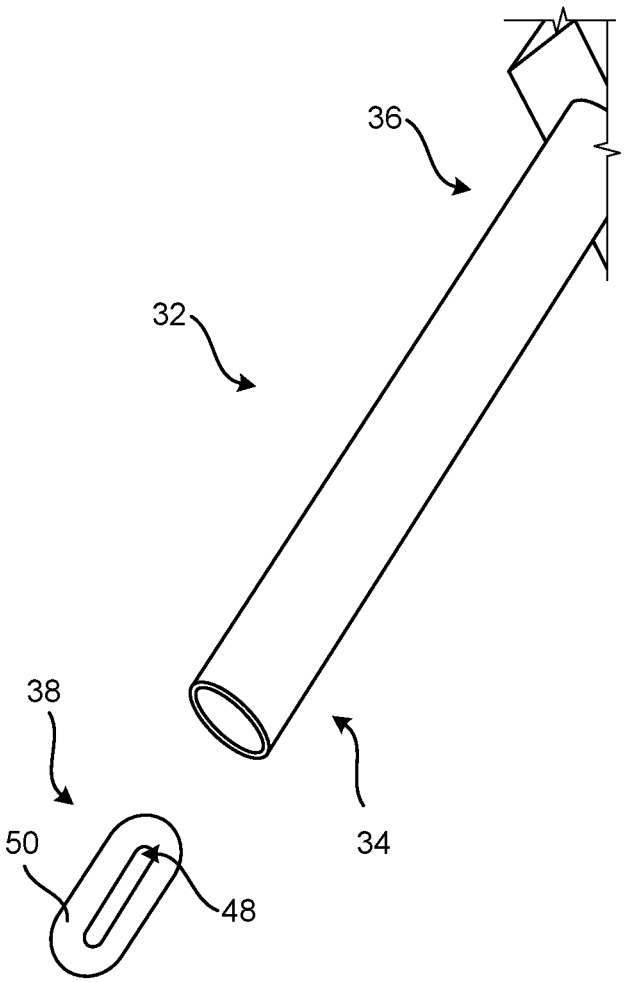
FIG. 3 is a perspective view of details of the illustrative atomic oven of FIG. 2.

Referring additionally to FIG. 3, in various embodiments the source of atoms 38 may include a metal 48 that is disposed in an openable ampoule 50. In some embodiments the metal 48 may include an alkali metal such as, for example, rubidium or cesium. In some other embodiments the metal 48 may include an alkaline earth metal such as, for example, strontium or calcium. It will be appreciated that in embodiments in which alkaline earth metals are used use of higher temperature materials may be entailed. For example and without limitation, the tube 32 may be made of stainless steel or titanium and the seal 44 may be made of an indium alloy. As will be discussed further below, in some embodiments the openable ampoule 50 may include a glass ampoule (that is mechanically crushable) and a metal ampoule that is electrically openable.

In various embodiments the aperture 40 may include a capillary array, a circular aperture, a cylindrical hole, a square hole, a slit, or an array of slits.

In various embodiments, the heater assembly 42 may include a resistive heater (such as nichrome wire or the like), an inductive heating source, or a radiative heating source. In some embodiments, the heater assembly 42 may include a heater 52 configured to heat the source of atoms 38 (such as for purposes of activation and operation) and a heater 54 configured to heat the aperture 40 (for example, to help contribute to preventing clogging of the aperture 40).

In some embodiments the openable seal 44 may include a meltable seal. In some such embodiments the meltable seal may be made of a metal such as indium, an indium alloy, or lead. In some other embodiments the openable seal 44 may include a vacuum seal. In some such embodiments the vacuum seal may include an indium alloy, tin, a tin alloy, lead, or a lead alloy.

In some other embodiments the openable seal 44 may be openable responsive to electrical current. In various embodiments one or more thermal shields 56 may be disposed on an exterior surface of the tube 32. In some such embodiments the thermal shield(s) 56 may help contribute to trapping heat radiation. As such, it may be desirable for the thermal shield 56 to be made of material that is reflective at infrared heat wavelengths and that has low emissivity, such as a shroud made of polished gold-plated copper or aluminum or gold-plated polyimide film or mylar or the like.

Still referring to FIGS. 2 and 3, in various embodiments an illustrative collimated atomic beam source 60 includes a vacuum chamber 62. In such embodiments the collimated beam atomic oven 30 is disposed in the vacuum chamber 62. As discussed above, the collimated beam atomic oven 30 includes: the tube 32 being disposed entirely in the vacuum chamber 62; the source of atoms 38 disposed in the portion 34 of the tube 32; the aperture 40 disposed in the portion 36 of the tube 32; the heater assembly 42 disposable in thermal communication with the tube 32; and the openable seal 44 disposed in the tube 32 intermediate the source of atoms 38 and the aperture 40.

Details regarding the atomic oven 30 have been explained above. It will be appreciated that details of the atomic oven 30 need not be repeated for an understanding of disclosed subject matter.

In various embodiments a mounting flange 64 is configured to sealably mount the atomic oven 30 in the vacuum chamber 62. In some such embodiments a thermally insulating standoff 64 is disposed between the mounting flange 64 and the tube 32. The thermally insulating standoff 66 is configured to thermally insulate the tube 32 from the mounting flange 64 and the vacuum chamber 62.

In various embodiments the thermally insulating standoff 66 may be made of a material having low thermal conductivity, such as plastic, ceramic, PEEK, polyetherimide such as ULTEM™, thin-walled stainless steel structures, thin-walled titanium structures, or the like.

Figure 4:
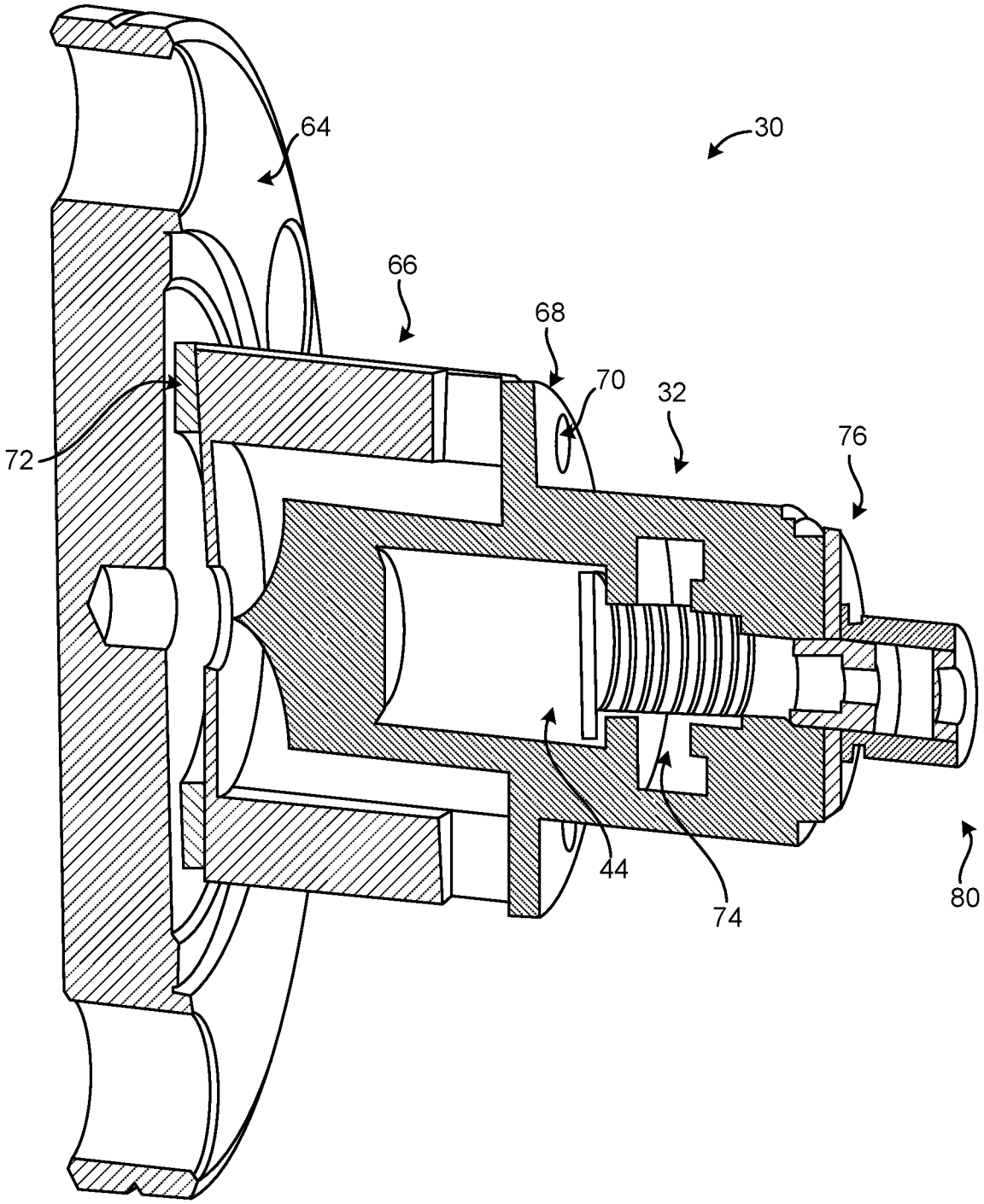
FIG. 4 is a perspective view in cutaway of details of the illustrative atomic oven of FIG. 2.

Referring additionally to FIG. 4, in some such embodiments the tube 32 is attached to the thermally insulating standoff 66. For example, in some embodiments a flange 68 may extend from the tube 32, and holes 70 are defined in the flange 68. Fasteners (not shown) are received in the holes 70 and fastenably engage the thermally insulating standoff 66 (such as by threaded engagement or the like) to attach the tube 32 to the thermally insulating standoff 66. Similarly, in some embodiments holes 72 are defined in the mounting flange 64. Fasteners (not shown) are received in the holes 72 and fastenably engage the thermally insulating standoff 66 (such as by threaded engagement or the like) to attach the thermally insulating standoff 66 to the mounting flange 64.

As shown in FIG. 4, in some embodiments a biasing member 74, such as a spring or the like, may be provided, if desired, to help the seal 44 to fully open after the seal 44 has been compromised.

As also shown in FIG. 4, in some embodiments one or more metal vapor shields 76 may be disposed on an end 78 of the tube 32 to help mitigate buildup of metal vapor in the vacuum chamber 62. In such embodiments, the metal vapor shield 76 is a cap that covers the end 78 of the tube 32. The metal vapor shield 76 defines an opening that is configured to permit a beam of atoms to pass therethrough. In some such embodiments, the metal vapor shield 76 can be machined from graphite. In some other such embodiments, the metal vapor shield 76 can be made of another material (such as, without limitation, glass, ceramic, copper, stainless steel, or titanium) and coated with a graphite coating.

As also shown in FIG. 4, in various embodiments a nozzle 80 may extend past the metal vapor shield 76. In such embodiments, the nozzle 80 includes the aperture 40 and, as such, is configured to collimate emitted atoms that exit through the opening in the metal vapor shield 76 into a collimated beam of atoms as desired for a particular application.

Figure 5:
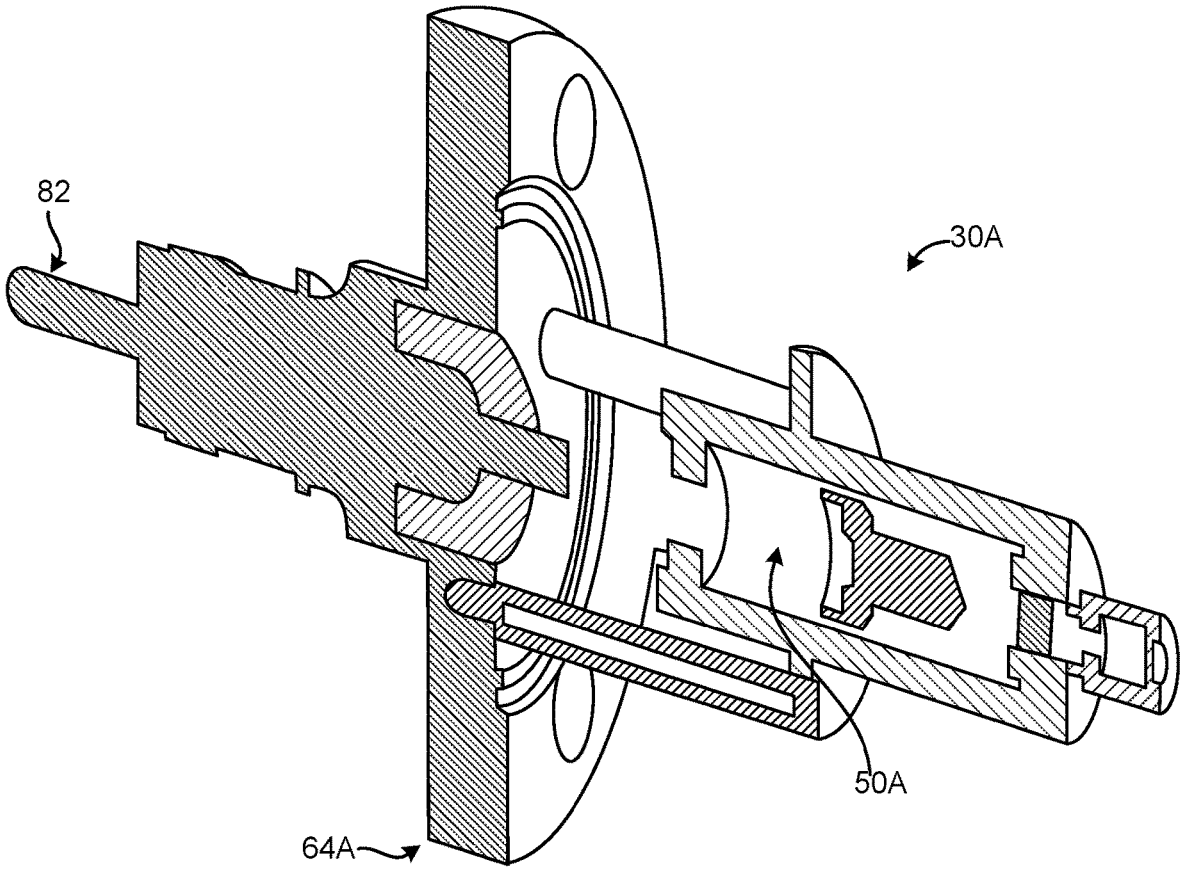
FIG. 5 is a perspective view in cutaway of details of another illustrative atomic oven.

Referring additionally to FIG. 5, in some other embodiments an electrical current pulse can open a hole into a metal ampoule to release atoms therethrough. In such embodiments, an atomic oven 30A includes a thin-walled metal ampoule 50A that contains the metal (not shown for clarity). An electrical current feedthru 82 sealably extends through a mounting flange 64 to permit the thin-walled metal ampoule 50A to be electrically connected to a source of electrical current sufficient to open a hole in the thin-walled metal ampoule 50A It will be appreciated that the amplitude of an electrical current pulse and, as a result, diameter of electrical conductor to deliver the electrical current, depend on thickness of the wall of the metal ampoule 50A Other components of the atomic oven 30A are similar to those of the atomic oven 30 (FIG. 4) and need not be repeated for an understanding of disclosed subject matter.

Now that illustrative details regarding construction of illustrative embodiments have been forth, operation of various embodiments will now be explained.

Figure 6A:
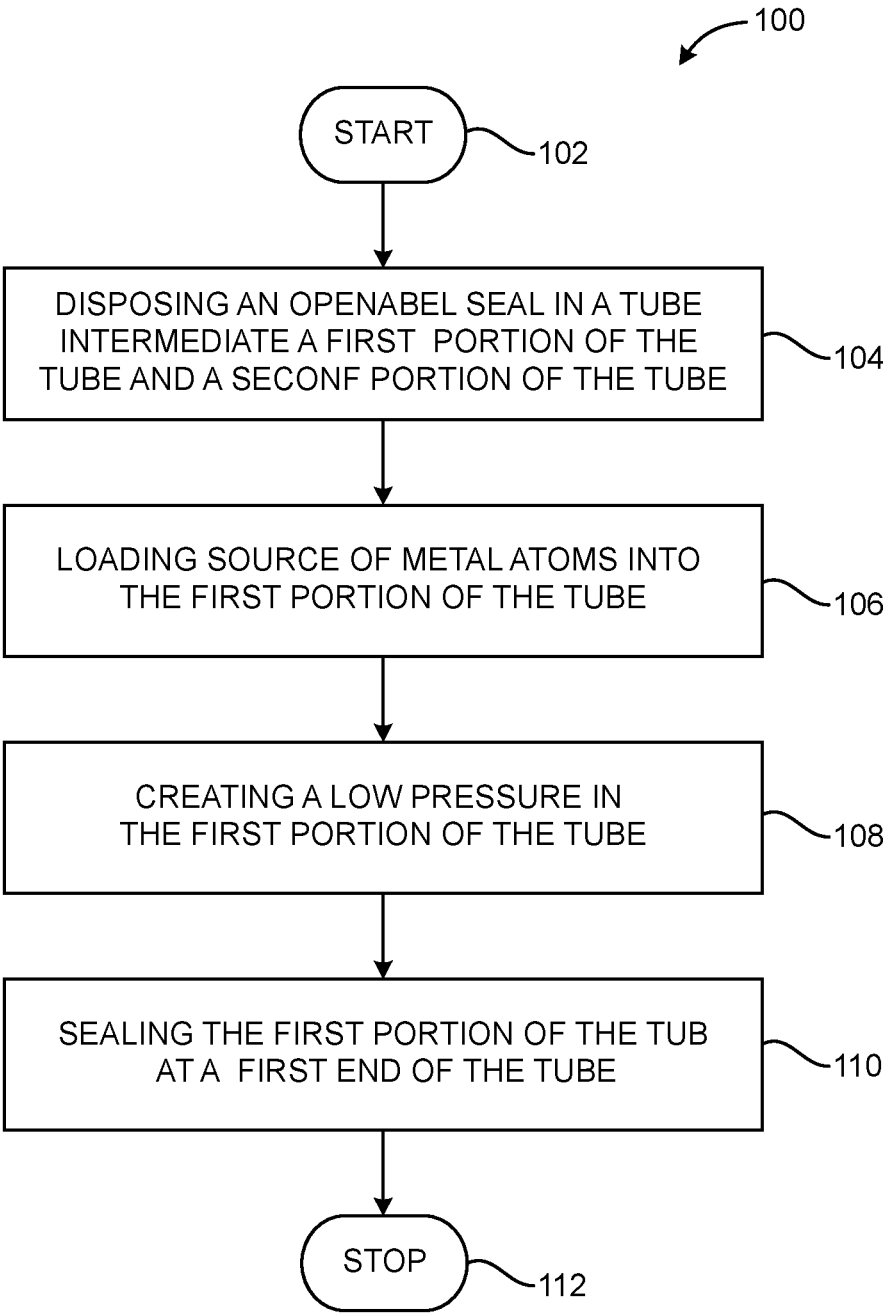
FIG. 6A is a flowchart of an illustrative method of loading a source of atoms into an atomic oven.

In various embodiments, a source of atoms is loaded into an atomic oven, such as the atomic oven 30 or 30A, as follows. Referring additionally to FIG. 6A, a method 100 starts at a block 102. At a block 104 an openable seal is disposed in a tube intermediate a first portion of the tube and a second portion of the tube. At a block 106 a source of atoms is loaded into the first portion of the tube. At a block 108 a low pressure is created in the first portion of the tube. At a block 110 the first portion of the tube is sealed at a first end of the tube. The method 100 stops at a block 112.

Figure 6B:
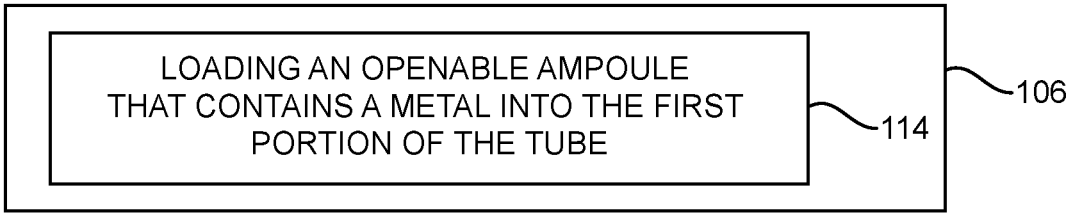
FIGS. 6B-6C and 6G-6H are flowcharts of details of the method of FIG. 6A.
Figure 6C:
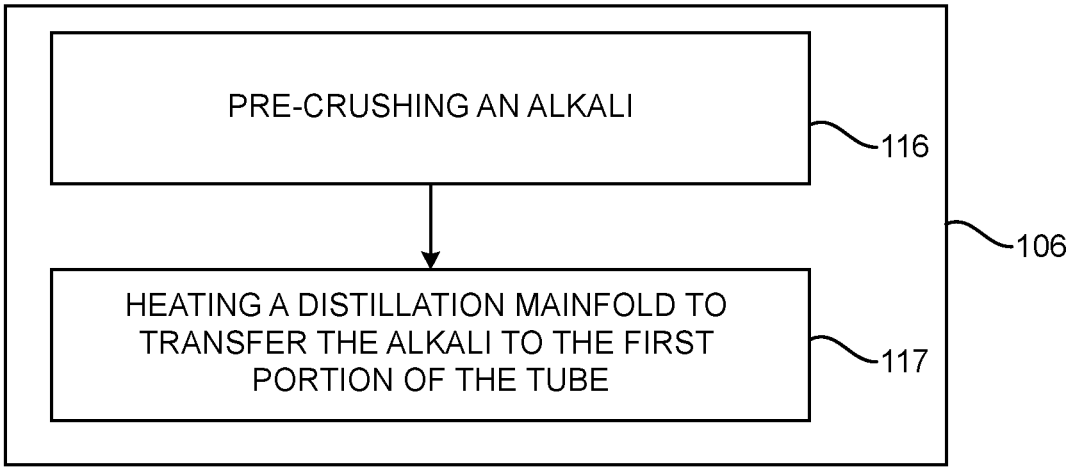

Referring additionally to FIG. 6B, in some embodiments loading a source of atoms into the first portion of the tube at the block 106 may include loading an openable ampoule that contains a metal into the first portion of the tube at a block 114. Referring additionally to FIG. 6C, in some other embodiments, loading a source of atoms into the first portion of the tube at the block 106 may include pre-crushing an alkali at a block 116 and heating a distillation manifold to transfer the alkali to the first portion of the tube at a block 117. For example and referring additionally to FIG. 6D, before pre-crushing the alkali at the block 116 an alkali 48 in a crushable ampoule 50 is loaded into a fill tube 90 that is sealed at one end 91 and opened at another end 92. The open end 92 of the fill tube 90 and the open end 46 of the first portion 34 of the tube 32 are sealably coupled via a vacuum adapter 93 and a low pressure is created. Referring additionally to FIG. 6E, the alkali is then pre-crushed at the block 116. Still referring to FIG. 6E, the fill tube 90 is heated and the first portion 34 of the tube 32 is cooled at the block 117. The metal thus transfers from the hot fill tube 90 to the cool first portion 34 of the tube 32. Referring additionally to FIG. 6F, the open end 46 of the first portion 34 of the tube 32 is crimped and sealed shut and the tube 32 is severed from the fill tube 90.

Figure 6D:
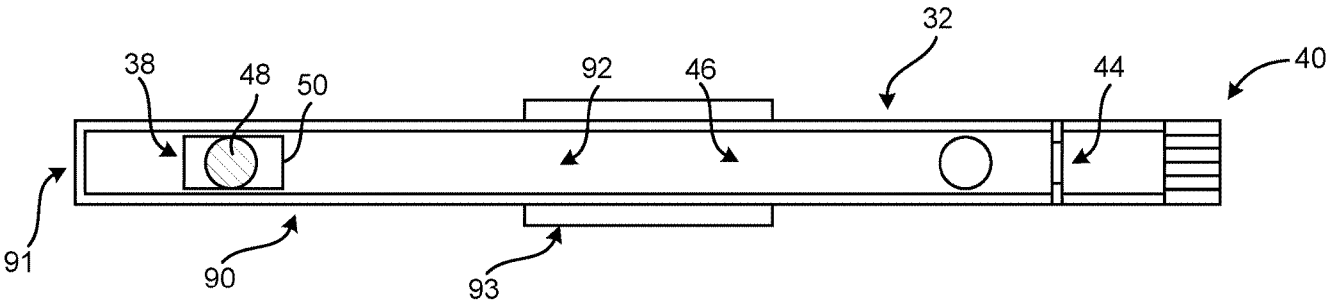
FIGS. 6D-6F are side plan views in cutaway of an illustrative distillation manifold for transferring metal to an atomic oven.
Figure 6E:
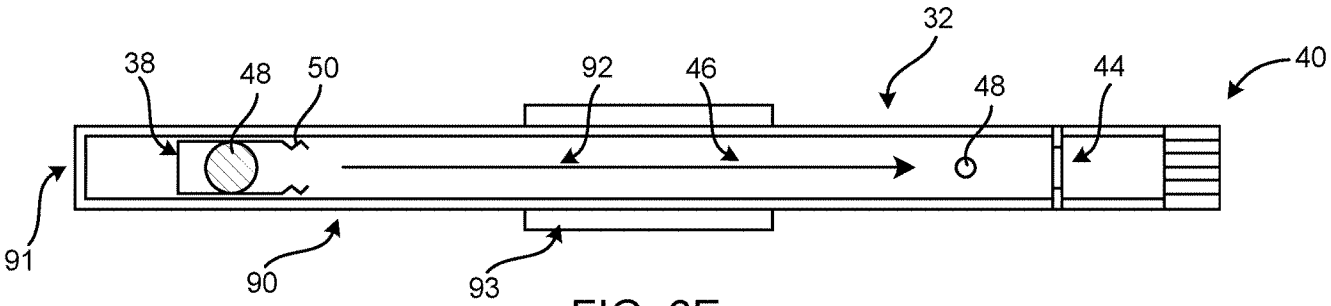
Figure 6F:
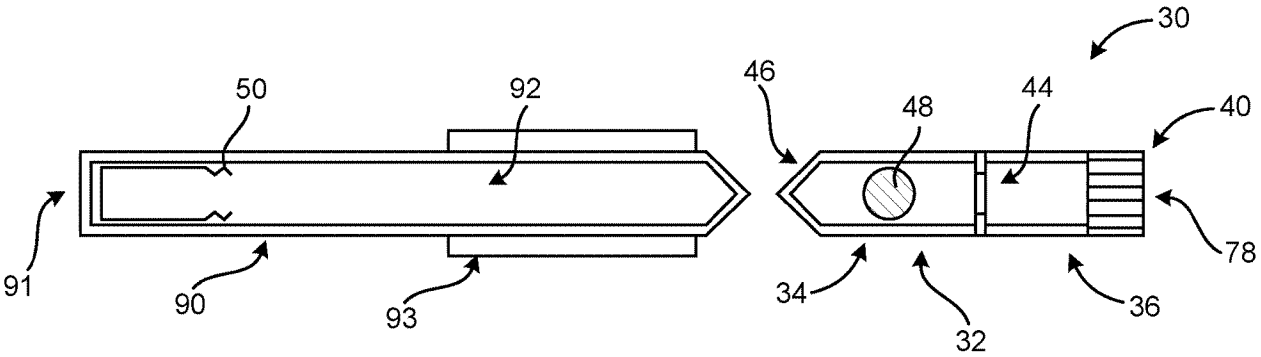
Figure 6G:
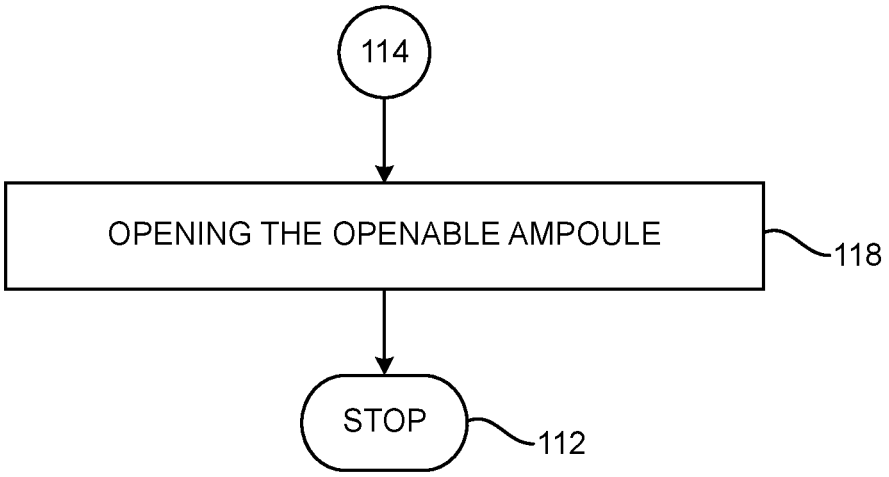
Figure 6H:
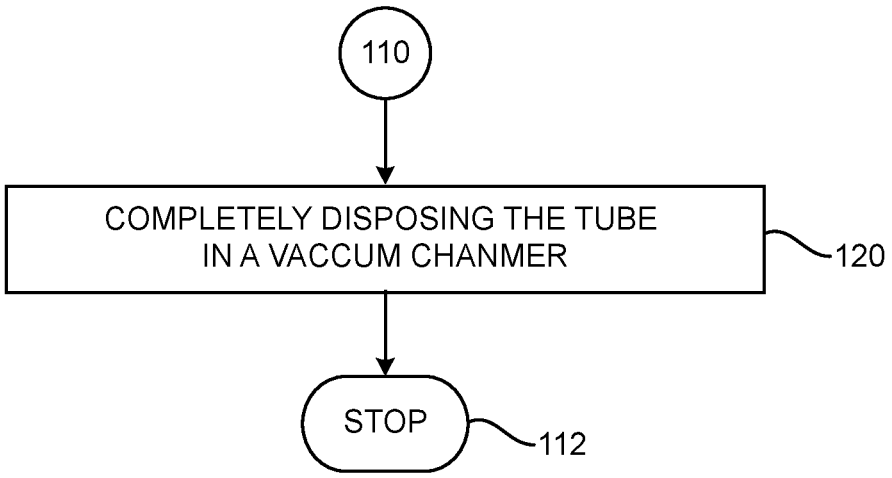

In embodiments in which an openable ampoule that contains a metal is loaded into the first portion of the tube and referring additionally to FIG. 6D, the openable ampoule is opened at a block 118. In such embodiments, opening the openable ampoule at the block 118 may be performed by a process such as mechanically crushing the openable ampoule, applying electrical current to a metal ampoule sufficient to open a hole in the metal ampoule, or heating a pre-crushed ampoule that is sealed with a sealant material to a temperature greater than a melting point of the sealant material. Regardless of how the ampoule is opened, it will be appreciated that the metal does not react with air because the tube has been evacuated and sealed via the openable seal.

After the first portion of the tube is sealed at the block 110 and referring additionally to FIG. 6E, the tube may be completely disposed in a vacuum chamber at a block 120. For example, the tube may be attached to one end of the thermally insulating standoff, another end of the thermally insulating standoff may be attached to the mounting flange, and the mounting flange may be sealably attached to the vacuum chamber.

Figure 7A:
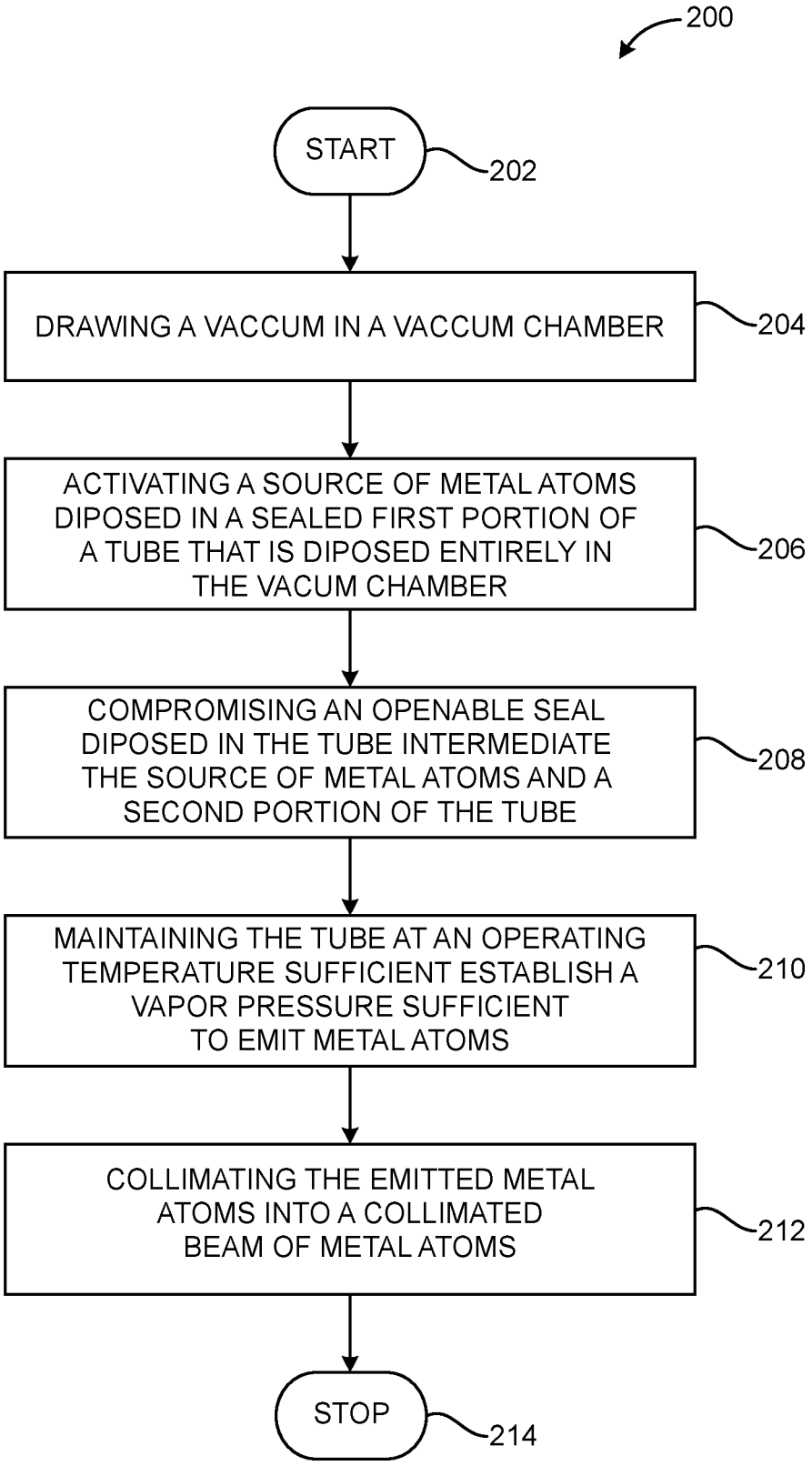
FIG. 7A is a flowchart of an illustrative method of forming a collimated beam of atoms.

In various embodiments, a collimated beam of atoms may be formed as follows. Referring additionally to FIG. 7A, a method 200 starts at a block 202. At a block 204 a vacuum is drawn in a vacuum chamber, such as the vacuum chamber 62. At a block 206 a source of atoms that is disposed in a sealed first portion of a tube (that is disposed entirely in the vacuum chamber) is activated. At a block 208 an openable seal that is disposed in the tube intermediate the source of atoms and a second portion of the tube is broken. At a block 210 the tube is maintained at an operating temperature sufficient to establish a vapor pressure sufficient to emit atoms. At a block 212 the emitted atoms are collimated into a collimated beam of atoms. The method 200 stops at a block 214.

Figure 7B:
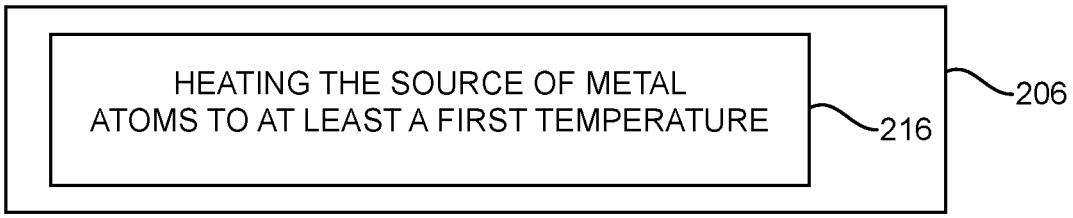
FIGS. 7B-7D are flowcharts of details of the method of FIG. 7A

Referring additionally to FIG. 7B, in various embodiments, activating the source of atoms at the block 206 may include heating the source of atoms to at least a first temperature—such as an operating temperature of the atomic beam source—at a block 216. In various embodiments, the operating temperature of the atomic beam source may be 100 degrees C. or less. As such and once activated, atoms can be emitted from the source of atoms.

Figure 7C:
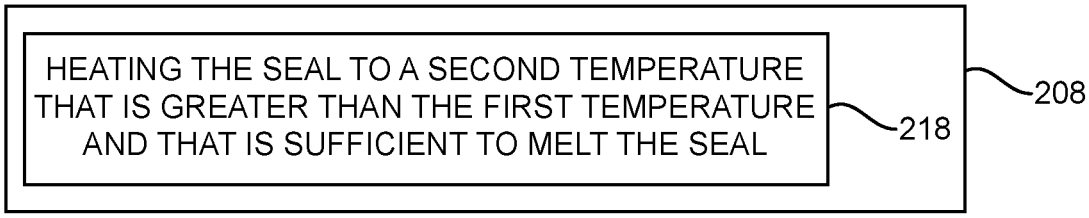

Referring additionally to FIG. 7C, in various embodiments comprising the openable seal at the block 208 may include heating the seal to a second temperature that is greater than the first temperature and that is sufficient to melt the seal at a block 218. For example and by way of illustration only, in various embodiments the seal may be raised to a temperature above the melting point of indium (157 degrees C.) responsive to achievement of sufficiently low pressure in the vacuum chamber, thereby compromising the indium seal and allowing the atomic beam to effusively emanate from the nozzle. It will be appreciated that the operating temperature of the atomic beam source (S. 100 degrees C.) is well below the indium melting point. At such temperatures, the indium (that makes up the openable seal) is solid and has negligible vapor pressure compared to the alkali metal. Because the source activation process entails no air-side access, the source assembly can be held completely in vacuum using low-thermal conductivity materials to reduce heat losses due to conduction. Also, because the entire assembly is completely in vacuum, there are no convective heat losses. Moreover, it will be appreciated that the heating mechanism used to open the openable seal is the same heating mechanism used for activating the source of atoms. As such, no additional electrical leads or access to the vacuum chamber is entailed in activating the source of atoms.

Figure 7D:
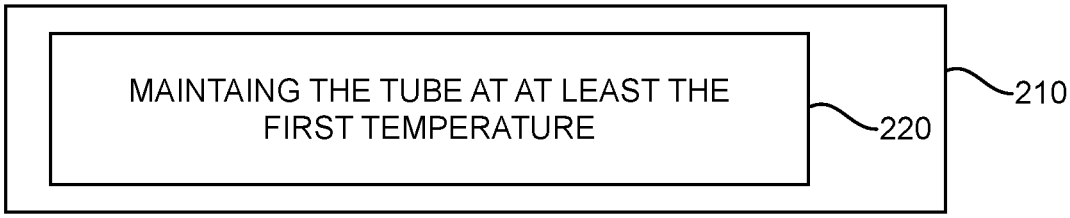

Given by way of non-limiting example and referring additionally to FIG. 7D, m various embodiments maintaining the tube at the operating temperature at the block 210 may include maintaining the tube at at least the first temperature at a block 220. As mentioned above, in various embodiments the operating temperature of the atomic beam source may be 100 degrees C. or less. In some such embodiments, typical power consumption for an atomic beam source operating at a temperature of 100 degrees C. is <300 mW.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A collimated beam atomic oven comprising:

a tube having a first portion and a second portion;

a source of atoms disposed in the first portion of the tube and having an operating temperature sufficient to establish a vapor pressure sufficient to emit atoms;

a nozzle including an aperture disposed in the second portion of the tube and configured to receive the atoms emitted from the source of atoms and further configured to emit a collimated beam of the atoms emitted from the source of atoms;

a meltably openable seal disposed in the tube intermediate the source of atoms and the aperture and having a melting point greater than the operating temperature; and a heater assembly disposed in the second portion of the tube, the heater assembly including:

a first heater configured to heat the source of atoms to at least the operating temperature and further configured to heat the meltably openable seal to at least the melting point; and a second heater configured to heat the aperture;

a mounting flange configured to sealably mount the atomic oven in a vacuum chamber; and a thermally insulating standoff disposed between the mounting flange and the tube, the thermally insulating standoff being configured to thermally insulate the tube from the mounting flange and the vacuum chamber.

2. The atomic oven of claim 1, wherein the tube is made of at least one material chosen from copper, stainless steel, and titanium.

3. The atomic oven of claim 1, wherein the source of atoms includes a metal disposed in an openable ampoule.

4. The atomic oven of claim 3, wherein the metal includes an alkali metal.

5. The atomic oven of claim 4, wherein the alkali metal includes a metal chosen from rubidium and cesium.

6. The atomic oven of claim 3, wherein the metal includes an alkaline earth metal.

7. The atomic oven of claim 6, wherein the alkaline earth metal includes a metal chosen from strontium and calcium.

8. The atomic oven of claim 1, wherein the aperture includes an aperture chosen from a capillary array, a circular aperture, a cylindrical hole, a square hole, a slit, and an array of slits.

9. The atomic oven of claim 1, wherein the heater assembly includes a heater chosen from a resistive heater, an inductive heating source, and a radiative heating source.

10. The atomic oven of claim 1, wherein the meltably openable seal is made of a metal chosen from indium, an indium alloy, and lead.

11. The atomic oven of claim 1, wherein the seal includes a vacuum seal.

12. The atomic oven of claim 11, wherein the vacuum seal includes an indium alloy, tin, a tin alloy, lead, and a lead alloy.

13. The atomic oven of claim 1, wherein the seal is openable responsive to electrical current.

14. The atomic oven of claim 1, further comprising:

at least one thermal shield disposed on an exterior surface of the tube.

15. The atomic oven of claim 1, further comprising:

at least one metal vapor shield disposed on an exterior surface of the tube, the metal vapor shield defining an opening configured to permit a beam of atoms to pass therethrough.

16. A collimated atomic beam source comprising:

a vacuum chamber; and a collimated beam atomic oven disposed in the vacuum chamber, the collimated beam atomic oven including:

a tube having a first portion and a second portion, the tube being disposed entirely in the vacuum chamber;

a source of atoms disposed in the first portion of the tube and having an operating temperature sufficient to establish a vapor pressure sufficient to emit atoms;

a nozzle including an aperture disposed in the second portion of the tube and configured to receive the atoms emitted from the source of atoms and further configured to emit a collimated beam of the atoms emitted from the source of atoms;

a meltably openable seal disposed in the tube intermediate the source of atoms and the aperture and having a melting point greater than the operating temperature; and a heater assembly disposed in the second portion of the tube, the heater assembly including:

a first heater configured to heat the source of atoms to at least the operating temperature and further configured to heat the meltably openable seal to at least the melting point; and a second heater configured to heat the aperture.

17. The collimated atomic beam source of claim 16, further comprising:

a mounting flange configured to sealably mount the atomic oven in the vacuum chamber; and a thermally insulating standoff disposed between the mounting flange and the tube, the thermally insulating standoff being configured to thermally insulate the tube from the mounting flange and the vacuum chamber.

18. The collimated atomic beam source of claim 17, wherein the thermally insulating standoff is made of a material chosen from plastic, ceramic, PEEK, polyetherimide, thin-walled stainless steel, and thin-walled titanium.

19. A collimated atomic beam source comprising:

a vacuum chamber;

a collimated beam atomic oven disposed in the vacuum, the collimated beam atomic oven including:

a tube having a first portion and a second portion, the tube being disposed entirely in the vacuum chamber;

a metal disposed in an openable ampoule that is disposed in the first portion of the tube chamber and having an operating temperature sufficient to establish a vapor pressure sufficient to emit atoms;

a nozzle including an aperture disposed in the second portion of the tube and configured to receive the atoms emitted from the source of atoms and further configured to emit a collimated beam of the atoms emitted from the source of atoms;

a meltably openable seal disposed in the tube intermediate the metal and the aperture and having a melting point greater than the operating temperature; and a heater assembly disposed in the second portion of the tube, the heater assembly including:

a first heater configured to heat the atomic oven to at least the operating temperature and further configured to heat the meltably openable seal to at least the melting point; and a second heater configured to heat the aperture;

a mounting flange configured to sealably mount the atomic oven in the vacuum chamber; and a thermally insulating standoff disposed between the mounting flange and the tube, the thermally insulating standoff being configured to thermally insulate the tube from the mounting flange and the vacuum chamber.

* * * * *